United States Patent [19]

Polak et al.

[11] 4,448,110

[45] May 15, 1984

[54] HYDRAULIC PUMP

[75] Inventors: Paul R. Polak; Daniel E. Jantzen, both of Arvada, Colo.

[73] Assignee: P & W Pumping-Jack Co., Arvada, Colo.

[21] Appl. No.: 313,234

[22] Filed: Oct. 20, 1981

Related U.S. Application Data

[63] Continuation of Ser. No. 125,182, Feb. 27, 1980, abandoned.

[51] Int. Cl.[3] ..... F01L 25/08; F01L 31/08; F01L 23/00

[52] U.S. Cl. ..... 91/275; 91/279; 91/341 R

[58] Field of Search ..... 91/275, 279, 341 R

[56] References Cited

U.S. PATENT DOCUMENTS

| | | | |
|---|---|---|---|
| 2,258,103 | 10/1941 | Scheider | 60/413 |
| 2,292,331 | 8/1942 | Vertson | 91/314 |
| 2,691,962 | 10/1954 | Johnson | 91/275 |
| 2,949,098 | 8/1960 | Flick | 91/275 |
| 3,382,770 | 5/1968 | Berninger et al. | 91/275 |

*Primary Examiner*—Paul E. Maslousky
*Attorney, Agent, or Firm*—Edwin L. Spangler, Jr.

[57] ABSTRACT

This invention relates to an improved pump jack characterized by a hollow piston rod which telescopes down over the sucker rod to which it is clamped for reciprocating motion. The cylinder, in turn, is fastened in fixed position directly to the upper exposed end of the well casing. As fluid is introduced into the lower end of the cylinder it raises the piston into engagement with a pushrod housed in the upper cylinder head that lifts switch-actuating means associated therewith into a position operative to actuate a switch located adjacent thereto thereby causing the latter to change state and actuate a multi-function solenoid valve so as to cut off fluid flow to the cylinder. As gravity lowers the sucker rod and piston exhausting the hydraulic fluid therebeneath, an adjustable stop engages the pushrod from above so as to return it together with the switch-actuating means associated therewith to their original positions thereby resetting the switch to complete the operating cycle.

6 Claims, 3 Drawing Figures

10
12
14
16
18
20U
20L
22
24
26
28
30
32A
32B
32C
34
36
38
40
42
44
46
48
52
54
56
58
60
62
64
66
68
70
74
76
78
80
82
84
86
88
90
92
94
96
98
100
102
104
106
108
110
112
114
116
142
V REL
P

HYDRAULIC PUMP

This is a continuation of application Ser. No. 125,182, filed Feb. 27, 1980 now abandoned.

Hydraulic jacks for pumping oil and other fluids from both deep and shallow wells are well known in the art and are exemplified by patents such as U.S. Pat. No. 2,985,432 issued to McCray back in 1961 and the earlier patents to Scheider, No. 2,258,103 and Vertsor et al, No. 2,292,331 issued back in the early '40's. As far as the jack itself is concerned, Deitrickson's U.S. Pat. No. 2,756,562 discloses a rather fundamental system. Hydraulic cylinders have also been used in conjunction with mechanical systesm to pump oil, such systems being the subject matter of the U.S. Pat. No. to James 3,782,117 which issued only recently and the much earlier patent to Saxe, No. 2,184,437.

An important aspect of pumping jacks like the above is the means used to control the excursion of the piston. Some, like Deitrickson, merely recite that the system includes "suitable reversing valves" while others such as James go into considerable detail with respect to the control circuitry. In the latter, a pressure-responsive switch operatively associated with the movement of an air piston is used to actuate a two-position four-way solenoid valve not too much different than that which controls the flow of hydraulic fluid in the instant pumping apparatus. None of these prior art systems, however, reveals a control system like applicants' wherein a piston actuated pushrod is employed to change the state of an electrical circuit containing a reversing valve that functions upon actuation to control the flow of fluid to a hydraulic servomotor. Once the state of the circuit is changed, the pushrod maintains the circuit in its altered condition until the piston, piston rod and sucker rods attached to the latter gravitate to a preselected position determined by an adjustable stop. This stop, in turn, returns the control switch to its original state and resets the pushrod preparatory to completion of another power stroke.

The other aspect of the instant invention which appears to be novel is the mechanical arrangement whereby a hollow piston rod is used and telescoped down over the emerging end of the sucker rod to which it is clamped. The cylinder is then attached in fixed position to the upper end of the well casing by means of a standard coupling depending from the lower header closing the end of the cylinder.

The resulting pumping system is exceedingly simple and has the distinct advantage of being easily fitted to existing wells as a replacement for the more conventional mechanical jacks. Both the casing and the sucker rod are already in place and one need only slide the hollow piston rod down over the exposed free end of the sucker rod and clamp it thereto preparatory to screwing the cylinder into the casing to essentially complete the mechanical part of the installation. Moreover, by using the hinged plate on the top of the cylinder as both a carrier for the control switch and a cover therefor and for the pushrod, dust, ice, water and other contaminants commonly found in the oil fields are effectively excluded, at least insofar as causing the system to malfunction.

It is, therefore, the principal object of the present invention to provide a novel and improved pump jack for oil wells and the like.

A second objective of the invention is the provision of a jack of the type described which is readily adapted for use on existing wells as a replacement for the present jack.

Another object is to provide a control system for a hydraulic servomotor connected to operate a string of sucker rods that is much simpler and more reliable than prior art hydraulic pumps for the same purpose.

Still another objective is the provision of a pump jack that requires only two simple mechanical connections to place it in service.

An additional object is to provide a pump jack that includes an extremely simple mechanical adjustment for varying the length of the stroke.

Further objects are to provide a pumping system of the type aforementioned which is safe, reliable, easy to service, relatively inexpensive, rugged and ideally suited for use in remote locations under adverse weather conditions.

Other objects will be in part apparent and in part pointed out specifically hereinafter in connection with the description of the drawings that follows, and in which.

Figures 1, 2, 3:
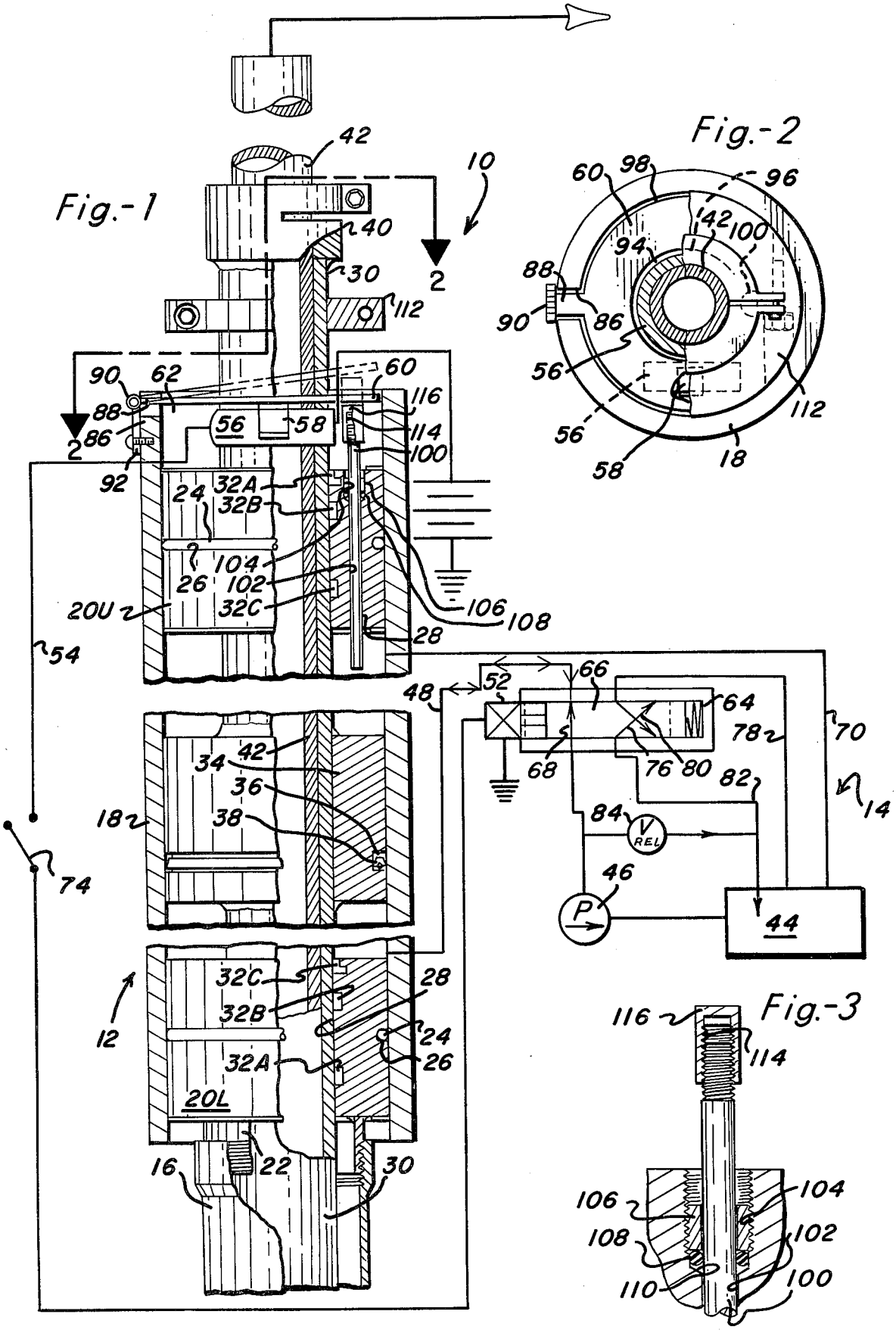
FIG. 1 is a view partly in section and partly in elevation showing the hydraulic servomotor and control system therefor connected between the casing and sucker rod string of a well, portions having been broken away to conserve space while others have been shown schematically.
FIG. 2 is a staggered transverse section taken along line 2—2 of FIG. 1.
FIG. 3 is a greatly enlarged fragmentary detail partly in section and partly in elevation showing the details of the pushrod and the mounting thereof for reciproacting motion.

Referring next to the drawings for a detailed description of the present invention, and initially to FIG. 1 thereof, reference numeral 10 has been selected to designate the pumping system in its entirety while numerals 12 and 14 have been chosen to similarly connote the hydraulic servomotor and control system therefor, respectively. Reference numeral 16 refers to the female end of a conventional well casing as it emerges from the ground at the well head. Detachably fastened to the casing is the hydraulic cylinder 18 which has the cylinder head 20L at the lower end thereof fitted with a suitable externally-threaded male connector 22 for making such connection. Both the lower cylinder head 20L and the upper one 20U are encircled by a conventional O-ring seal 24 seated within an annular groove 26. These seals, of course, provide fluid-tight seals between the heads and cylinder wall.

Both cylinder heads also contain axial bores 28 within which the hollow tubular piston rod 30 reciprocates. Internal annular grooves 32A, 32B and 32C are provided to receive conventional shaft packings (not shown). Fixedly attached to piston rod 30 is the piston 34 intermediate the cylinder heads 20. It, too, is encircled by an annular groove 36 containing a piston ring 38 which defines a sliding seal against the cylinder wall.

The upper end of the piston rod 30 projects well above the top of the cylinder 18 and carries a clamp ring 40. The purpose of this ring is to detachably fasten the piston rod to the sucker rod 42 which is telescopically received therein. The sucker rod, of course, carries the oil taken from the well and delivers it to a suitable storage facility or pipeline through a flexible connection, none of the latter having been shown.

Hydraulic fluid pumped from reservoir 44 by means of pump 46 enters the hydraulic servomotor 12 through fluid line 48 after passing through a two position solenoid-actuated four way valve, only three passages of which are used, that has been broadly designated by reference numeral 50. The incoming hydraulic fluid is, obviously, introduced beneath the piston 34 and is used to raise the latter along with the piston rod 30 and the sucker rod 42 fastened to the latter. Energization of solenoid 52 is accomplished by means of an electrical circuit which has been illustrated schematically by reference numeral 54. Included within this circuit is a noramally-closed mercury switch 56 fastened by means of a spring clip 58 or other suitable connector to the underside of a hinged plate 60 which covers open-topped compartment 62 in the top of the servomotor 12. In the full line position shown, switch 56 is closed and the bias of spring 64 is overcome by energization of solenoid 52 so as to shift spool 66 in a direction such that the fluid pumped from the reservoir enters the servomotor 12 beneath the piston through line 48 after passing through passage 68 in the valve. Air along with any fluid exhausted from the servomotor above the piston returns to the reservoir through line 70 in the particular arrangement shown. Switch 74 of the circuit provides a means for shutting down the pump jack which would otherwise remain operative whenever switch 56 was closed. Opening of the latter switch, in the manner to be descirbed in detail presently, de-energizes the solenoid 52 and permits spring 64 to shift spool 66 to the left thus shunting the fluid around the servomotor and back into the reservoir 44 through valve passage 76 and return line 78. As the piston, piston rod and sucker rod gravitate downwardly, fluid pushed ahead of the piston is exhausted through line 48 and returned to the reservoir through passage 80 and line 82. A suitable pressure relief valve 84 is connected downstream of pump 46 with a connection into line 82.

The novelty of the instant pumping system lies elsewhere than in the pumping circuit just described which is conventional and easily replaceable with other circuits of similar design. Instead, at least part of the novelty present herein lies in the apparatus for actuating and deactuating the mercury switch within the aforesaid circuit, protecting it from the weather and other features that will now be described in detail in connection with both FIGS. 1 and 2 of the drawing.

The top edge of the cylinder 18 is notched as shown at 86 to receive the marginal tongue 88 projecting from the peripheral edge of the hinged plate 60. Tongue 88 is, in turn, hingedly attached by hinge pin 90 to a fixed leaf 92 that is bolted or otherwise fastened to the outside of the cylinder as shown.

Hinged plate 60 has the spring clip 58 fastened to the underside thereof near one edge so as to ride alongside the piston rod 56. A narrow annular gap 94 is left between the outside of the piston rod and the edge of the centerhole 96 in plate 60 which is just wide enough to accommodate the lifting of the latter into the phantom line position shown in FIG. 1 at which point the mercury switch 56 has opened to de-energize solenoid 52. An even narrower annular gap 98 separates the inside of the cylinder from the outside edge of plate 60. Plate 60 thus provides among other things a protective lid or cover over pushrod 100 which is mounted therebeneath for reciprocating movement within an eccentrically-positioned guidehole 102 that extends all the way through the upper cylinder head 20U. By thus protecting the pushrod from any major invasion of airborne dirt, rain and snow, its continued reliable operation is effectively assured.

In the particular form illustrated in FIG. 3 to which detailed reference will next be made, it can be seen that the upper extremity of guidehole 102 is enlarged and internally-threaded as indicated at 104 to receive externally-threaded plug 106 which urges O-ring seal 108 against the annular shoulder 110 at the base thereof. The pressure on O-ring 108 is adjusted such that it will frictionally engage pushrod 100 and maintain same along with hinged plate 60 in their phantom line actuated positions shown in FIG. 1 all during the return stroke of the piston and until engaged by adjustable stop 112 which functions to return these elements to their original full line deactuated positions. O-ring seal also functions in the customary manner to keep the hydraulic fluid from escaping past the pushrod.

Again with reference to FIG. 1, it can be seen that as the piston of the single-acting gravity-return hydraulic servomotor 12 rises in the cylinder, it will engage the lower end of the pushrod projecting beneath the upper cylinder head and raise it along with the hinged plate 60 resting atop thereof. As this happens, the mercury switch 56 carried by plate 60 raises and eventually becomes tilted to a degree where the mercury migrates to the left end thereof thus opening the switch and de-energizing solenoid 52.

In order to adjust the precise point at which mercury switch 56 opens, the upper end of pushrod 100 is threaded as shown at 114 to receive internally-threaded cap 116, all of which is most clearly revealed in FIG. 3. By threading cap 116 up or down the rod 100, the effective length of the latter can be adjusted to hasten or delay the opening of the mercury switch thus terminating the extension or power stroke of the servomotor.

Returning once again to FIGS. 1 and 2, it will be seen that adjustable stop 112 serves a different function than cap 116 which merely terminates the power stroke as noted but has nothing whatsoever to do with the length of the stroke. It is adjustable stop 112 that performs the latter function by engaging the hinged plate upon the return stroke of the piston and returning the mercury switch on its underside to its normally-closed position while, at the same time, retracting and resetting the pushrod. Obviously, the position of stop 112 along the piston rod 30 will determine how far down the lower end of cylinder 18 the piston 34 will gravitate before mercury switch 56 recloses to start fluid being pumped into the lower end of the cylinder. Thus, by adjusting stop 112, piston 34 is prevented from making a full length stroke if such is desired. The only time, therefore, it will return all the way down to where the hydraulic fluid enters the cylinder from line 48 will be when the main switch 74 is open.

In closing, it should be noted that hinged plate 60 need not define a fluid-tight cover protecting the pushrod and switch 56 since the latter is already essentially weatherproof by design and even if the pushrod were to freeze inside its guidehole, the weight of the sucker rod string, piston and piston rod resting atop thereof would easily break it free.

What is claimed is:

1. A pump jack for use on a well having a fixed casing accessible at the wellhead and a sucker rod string disposed within the casing for reciprocating movement which comprises: a hydraulic cylinder having upper and lower ends, said lower end being connectable to the casing in substantially coaxial relation atop thereof, and said lower end having a centrally-located opening therein sized to pass the sucker rod axially therethrough; a piston housed within the cylinder for axial movement between the ends thereof, said piston having a central opening therein sized to pass the sucker rod; a hollow piston rod fastened in coaxial position to the piston for movement therewith, said piston rod extending both above and below the piston being sized to telescope down over the sucker rod; said upper cylinder end having a central opening therein sized and adapted to receive the piston rod for relative axial movement therein while maintaining a fluid-tight seal therearound, said upper cylinder end having a pushrod opening therethrough substantially paralleling the central opening therein but displaced to one side thereof; a pushrod mounted for reciprocating movement within the pushrod opening in the upper cylinder end; switch-actuating means associated with said pushrod for movement therewith between a retracted and an extended position; said pushrod and piston cooperating during the power stroke of the latter toward the upper end of the cylinder to raise the switch-actuating means into extended position; friction means engaging said pushrod effective to maintain same and the switch-actuating means associated therewith in extended position upon retracting of said piston; clamp means carried by the piston rod for clamping same to the sucker rod for conjoint movement in response to movement of the piston; means comprising a stop carried by a piston rod for movement therewith, said stop being positioned to engage the switch-actuating means in extended position and return same together with the pushrod associated therewith to its retracted position by overpowering said friction means during the return stroke of the piston; first conduit means connectable to a source of fluid under pressure connected into the lower end of the cylinder; second conduit means connectable to the first conduit means for returning fluid exhausted from the cylinder to a reservoir; an electrically operated control valve operative in a first position to disconnect the second conduit from the first and connect the latter to the source of fluid under pressure, and said control valve being operative in a second position to disconnect said first conduit means from the pressurized source and connect same to the second conduit means; and, an electrical circuit including said valve and switch means for controlling the latter, said switch means being positioned for actuation by said switch-actuating means as the latter moves between its retracted and extended positions, said switch means being operative in the retracted position of said switch-actuating means to shift said valve into its first position, and said switch means being operative in the extended position of said switch-actuating means to shift said valve into its second position.

2. The pump jack as set forth in claim 1 wherein the switch means comprises a switch adapted to open and close in response to extension and retraction of said switch-actuating means.

3. The pump jack as set forth in claim 1 wherein the effective length of the pushrod can be varied to adjust the point of reversal of the piston at the completion of the power stroke.

4. The pump jack as set forth in claim 1 wherein the stop is adjustable along the piston rod to vary the length of the stroke.

5. The pump jack as set forth in claim 1 wherein the switch-actuating means comprises a hinged plate shaped to define a protective cover for both the switch means and pushrod.

6. The pump jack as set forth in claim 1 in which the pushrod opening includes an annular groove and an O-ring is seated within said groove, said groove and O-ring cooperating with one another to define the friction means engaging the pushrod.

* * * * *